US007302308B2

(12) United States Patent
Kato et al.

(10) Patent No.: US 7,302,308 B2
(45) Date of Patent: Nov. 27, 2007

(54) EMBROIDERY DATA PROCESSING DEVICE

(75) Inventors: Haruna Kato, Tsushima (JP); Atsuya Hayakawa, Chita (JP); Masakazu Kuki, Ichinomiya (JP); Masaki Shimizu, Toyoake (JP); Yasuhiko Kawaguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/313,630

(22) Filed: Dec. 22, 2005

(65) Prior Publication Data

US 2006/0137583 A1 Jun. 29, 2006

(30) Foreign Application Priority Data

Dec. 27, 2004 (JP) ..... 2004-375498
Dec. 27, 2004 (JP) ..... 2004-375499

(51) Int. Cl.
*D05C 5/02* (2006.01)

(52) U.S. Cl. ..... 700/138; 700/136; 700/137

(58) Field of Classification Search ..... 112/102.5; 700/130, 131, 133, 137, 138, 136
See application file for complete search history.

(56) References Cited

U.S. PATENT DOCUMENTS 5,144,899 A * 9/1992 Allen ..... 112/103
5,499,589 A * 3/1996 Kyuno et al. ..... 112/102.5
5,899,154 A * 5/1999 Mizuno ..... 112/102.5
5,934,209 A * 8/1999 Mizuno ..... 112/102.5
5,954,004 A * 9/1999 Futamura ..... 112/102.5
6,189,989 B1 * 2/2001 Hirabayashi et al. ..... 347/4
6,304,793 B1 * 10/2001 Komiya et al. ..... 700/138
RE38,718 E * 3/2005 Futamura ..... 700/138
2003/0212470 A1 * 11/2003 Kaymer et al. ..... 700/138
2004/0221783 A1 * 11/2004 Niimi ..... 112/475.01
2005/0015177 A1 * 1/2005 Hagino et al. ..... 700/132
2005/0182508 A1 * 8/2005 Niimi et al. ..... 700/138
2005/0234584 A1 * 10/2005 Mizuno et al. ..... 700/138

FOREIGN PATENT DOCUMENTS

JP 11076662 A * 3/1999
JP A 11-076662 3/1999

* cited by examiner

*Primary Examiner*—Gary L. Welch
*Assistant Examiner*—Nathan E Durham
(74) *Attorney, Agent, or Firm*—Oliff & Berridge, PLC

(57) ABSTRACT

There is provided a embroidery data processing device, which includes an extracting system that extracts at least one embroidery region from embroidery data that has a stitch attribute corresponding to at least one predetermined setting, and a print data generating system that generates print data for the at least one embroidery region extracted by the extracting system based on the embroidery data of the at least one embroidery region extracted by the extracting system.

24 Claims, 12 Drawing Sheets

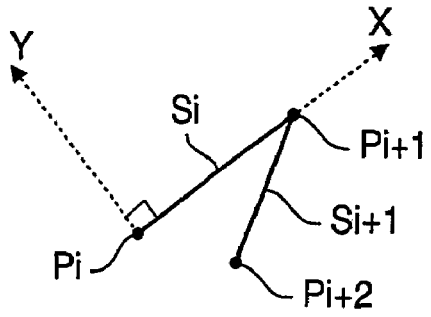
FIG.8A
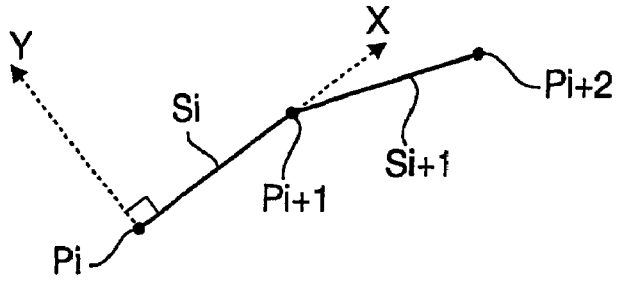
FIG.8B
14
<<SETTING FOR STITCH ATTRIBUTE TO BE TARGETED FOR PRINTING>>
STITCH FROM : TATAMI STITCH SATIN STITCH RUNNING STITCH
THREAD COLOR : RED BLUE GREEN YELLOW
PATTERN FORM : FRAME LETTER DESIGN
PRINT FORM : STITCH PRINTING FILLING
FIG. 9

14

<<SETTING FOR STITCH ATTRIBUTE TO BE TARGETED FOR PRINTING>>

STITCH FROM : TATAMI STITCH SATIN STITCH RUNNING STITCH
THREAD COLOR : RED BLUE GREEN YELLOW
PATTERN FORM : FRAME LETTER DESIGN
PRINT FORM : STITCH PRINTING FILLING

14

<<SETTING FOR STITCH ATTRIBUTE TO BE TARGETED FOR PRINTING>>

STITCH FROM : TATAMI STITCH SATIN STITCH RUNNING STITCH
THREAD COLOR : RED BLUE GREEN YELLOW
PATTERN FORM : FRAME LETTER DESIGN
PRINT FORM : STITCH PRINTING FILLING

14

<<SETTING FOR STITCH ATTRIBUTE TO BE TARGETED FOR PRINTING>>

STITCH FROM : TATAMI STITCH SATIN STITCH RUNNING STITCH
THREAD COLOR : RED BLUE GREEN YELLOW
PATTERN FORM : FRAME LETTER DESIGN
PRINT FORM : STITCH PRINTING FILLING

EMBROIDERY DATA PROCESSING DEVICE

CROSS-REFERENCE TO RELATED APPLICATION

This application claims priority under 35 U.S.C. §119 from Japanese Patent Applications No. 2004-375498, filed on Dec. 27, 2004, and No. 2004-375499, filed on Dec. 27, 2004. The entire subject matters of the applications are incorporated herein by reference.

BACKGROUND

1. Technical Field

The present disclosure relates to a device capable of generating print data from embroidery data used to embroider an embroidering pattern on fabric.

2. Description of Related Art

An embroidering device, having a function of generating a bitmap image of an embroidery pattern from embroidery data (i.e., a so-called stitch data containing a plurality of needle drop points) and printing out the bitmap image on fabric in addition to having a function of embroidering patterns on fabric, has been proposed. An example of such an embroidering device is disclosed in Japanese Patent Provisional Publication No. HEI 11-76662 (hereafter, referred to as JP-11-76662A).

As a technique for generating image data from embroidery data, it is disclosed in JP-11-76662A that a contour line is obtained for each of embroidery regions contained in embroidery data, and image data of the whole of an area defined by the contour line is generated for each embroidery region. In the embroidery data, a color designation code representing a thread color is contained at the top portion of each embroidery region. Therefore, by associating a color designation code with corresponding image data, it becomes possible to display and print out images of the embroidery regions in colors respectively corresponding to the color designation codes of the embroidery regions.

There is a demand for making fabric (e.g., a T-shirt) having an aesthetic design by harmonizing goodness of printing with goodness of embroidering. However, the technique disclosed in JP-11-76662A can not be used to harmonize goodness of printing with goodness of embroidering. The reason is that in the device disclosed in JP-11-76662A only contour lines of embroidery regions are obtained from embroidery data and each area surrounded by each contour line (each embroidery region) is filled with a color corresponding to a color designation code assigned to each embroidery region before performing an embroidering operation based on the embroidery data, and therefore all of the embroidery regions are filled with respective solid colors. The technique disclosed in JP-11-76662A can not enable an operator of the device to designate a part of the embroidery regions as printing regions to be targeted for printing.

SUMMARY

Aspects of the present disclosure are advantageous in that an embroidery data processing device capable of forming an aesthetic design on fabric by harmonizing goodness of printing with goodness of embroidering is provided.

BRIEF DESCRIPTION OF THE ACCOMPANYING DRAWINGS

FIG. 1 schematically shows a configuration of an embroidering and printing system according to first and second embodiments of the disclosure.

FIG. 8A illustrates an example of a stitch pattern having turning back of stitches.

FIG. 8B illustrates an example of a stitch pattern not having turning back of stitches.

FIG. 9 illustrates an example of a setting screen for stitch attributes to be targeted for printing.

DETAILED DESCRIPTION

General Overview

Figure 1:
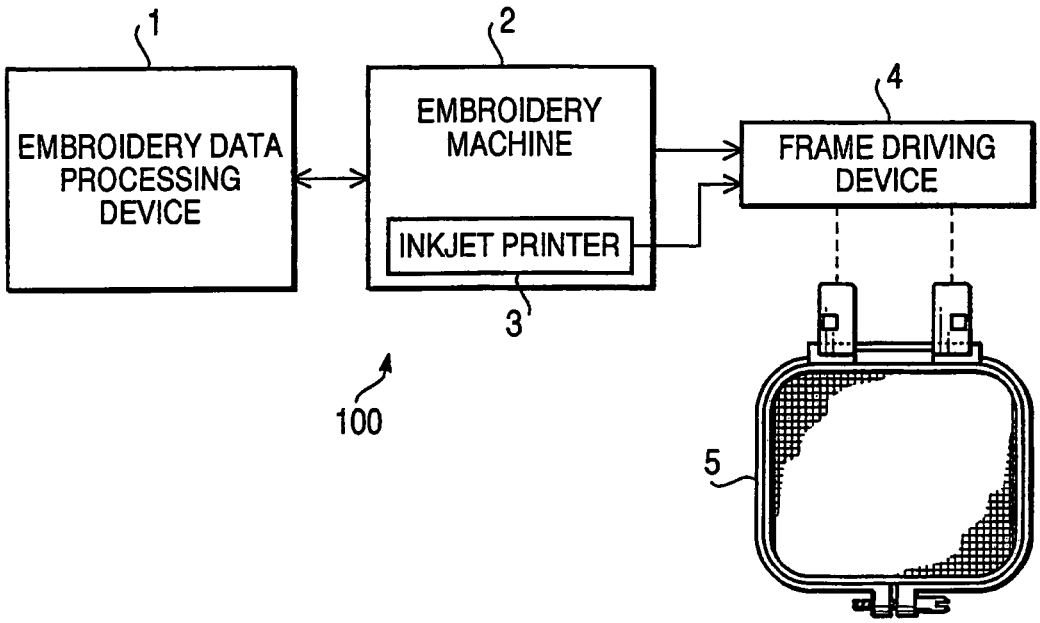

According to an aspect of the disclosure, there is provided an embroidery data processing device, which is provided with an extracting system that extracts at least one embroidery region from embroidery data that has a stitch attribute corresponding to at least one predetermined setting, and a print data generating system that generates print data for the at least one embroidery region extracted by the extracting system based on the embroidery data of the at least one embroidery region extracted by the extracting system.

With this configuration, both of goodness of embroidering and goodness of printing can be represented on fabric, and therefore fabric on which texture, stereoscopic effect and the sense of gorgeous are suitably represented can be obtained.

Optionally, the embroidery data processing device may include a setting system that allows an operator to designate the at least one predetermined setting.

Still optionally, the at least one predetermined setting may include at least one of stitch forms including tatami stitch, satin stitch and running stitch.

Still optionally, the at least one predetermined setting may include at least one thread color.

Still optionally, the at least one predetermined setting may include at least one pattern form.

Still optionally, the at least one pattern form may include one of a frame, a letter and a design.

Still optionally, the embroidery data processing device may include a block making system that divides one of embroidery regions of the embroidery data into a plurality of blocks, and a print block designation system that allows an operator to select a block from among the plurality of blocks. In this case, the print data generating system may operate to generate print data for the selected block.

Still optionally, the print data generated by the print data generating system may represent stitches linking sequentially needle drop points in the at least one embroidery region.

Still optionally, the print data generated by the print data generating system may represent data for filling the at least one embroidery region.

Still optionally, the print data generating system may operate to delete the embroidery data of the at least one embroidery region.

Still optionally, the embroidery data processing device may include an embroidery machine that embroiders an embroidery pattern based on the embroidery data.

Still optionally, the embroidery data processing device may include a print form setting system that allows an operator to select one of print forms including solid color printing for filling the at least one embroidery region in a color and stitch printing for representing stitches in the at least one embroidery region. In this case, the print data generating system generates the print data according to the selected one of the print forms.

Still optionally, the embroidery data processing device may include a storage device in which the embroidery data is stored.

According to another aspect of the disclosure, there is provided a computer program product for use on a computer, the computer program product comprising a computer program that causes the computer, when executed, to perform a method of generating print data based on embroidery data. The method includes the steps of analyzing the embroidery data to extract at least one embroidery region from the embroidery data that has a stitch attribute corresponding to at least one predetermined setting, and generating print data for the at least one embroidery region based on the embroidery data of the at least one embroidery region.

With this configuration, both of goodness of embroidering and goodness of printing can be represented on fabric, and therefore fabric on which texture, stereoscopic effect and the sense of gorgeous are suitably represented can be obtained.

Optionally, the method may include the step of allowing an operator to designate the at least one predetermined setting.

Still optionally, the at least one predetermined setting may include at least one of stitch forms including tatami stitch, satin stitch and running stitch.

Still optionally, the at least one predetermined setting may include at least one thread color.

Still optionally, the at least one predetermined setting may include at least one pattern form.

Still optionally, the at least one pattern form may include one of a frame, a letter and a design.

Still optionally, the method may include the steps of dividing one of embroidery regions of the embroidery data into a plurality of blocks, and allowing an operator to select a block from among the plurality of blocks. In this case, in the generating step, print data for the selected block may be generated.

Still optionally, the print data generated by the generating step may represent stitches linking sequentially needle drop points in the at least one embroidery region.

Still optionally, the print data generated by the generating step may represent data for filling the at least one embroidery region.

Still optionally, the generating step may include deleting the embroidery data of the at least one embroidery region.

Still optionally, the method may include the step of allowing an operator to select one of print forms including solid color printing for filling the at least one embroidery region in a color and stitch printing for representing stitches in the at least one embroidery region. In this case, in the generating step, the print data according to the selected one of the print forms may be generated.

According to another aspect of the disclosure, there is provided an embroidery data processing device, which is provided with a pattern division system that analyzes embroidery data to divide the embroidery data into a plurality of embroidery regions according to a predetermined division criterion, a designation system that allows an operator to select one or more of the embroidery regions divided by the pattern division system, and a print data generating system that generates print data for the one or more embroidery regions selected by the operator based on the embroidery data corresponding to the one or more embroidery regions.

With this configuration, both of goodness of embroidering and goodness of printing can be represented on fabric, and therefore fabric on which texture, stereoscopic effect and the sense of gorgeous are suitably represented can be obtained.

According to another aspect of the disclosure, there is provided a computer program product for use on a computer, the computer program product comprising a computer program that causes the computer, when executed, to perform a method of generating print data based on embroidery data. The method includes the steps of analyzing embroidery data to divide the embroidery data into a plurality of embroidery regions according to a predetermined division criterion, allowing an operator to select one or more of the embroidery regions divided by the analyzing step, and generating print data for the one or more embroidery regions selected by the operator based on the embroidery data corresponding to the one or more embroidery regions.

With this configuration, both of goodness of embroidering and goodness of printing can be represented on fabric, and therefore fabric on which texture, stereoscopic effect and the sense of gorgeous are suitably represented can be obtained.

Aspects of the disclosure may be implemented in computer software as programs storable on computer-readable media including but not limited to RAMs, ROMs, flash memory, EEPROMs, CD-media, DVD-media, temporary storage, hard disk drives, floppy disks, permanent storage, and the like.

Embodiments

Hereafter, embodiments according to the disclosure will be described with reference to the accompanying drawings.

First Embodiment

FIG. 1 schematically shows a configuration of an embroidering and printing system 100 including an embroidery data processing device 1, an embroidery machine 2 and a frame driving device 4. In the system 100, the embroidery data processing device 1 is connected to the embroidery machine 2 having an inkjet printer 3, and the frame driving device 4 is connected to the embroidery machine 2. One of various types of embroidery frames 5 can be detachably attached to the frame driving device 4.

The frame driving device 4 is configured to move the embroidery frame 5, in two directions intersecting at right angles, for an embroidery operation to be executed by the embroidery machine 2 and a printing operation to be executed by the inkjet printer 3.

Figure 2:
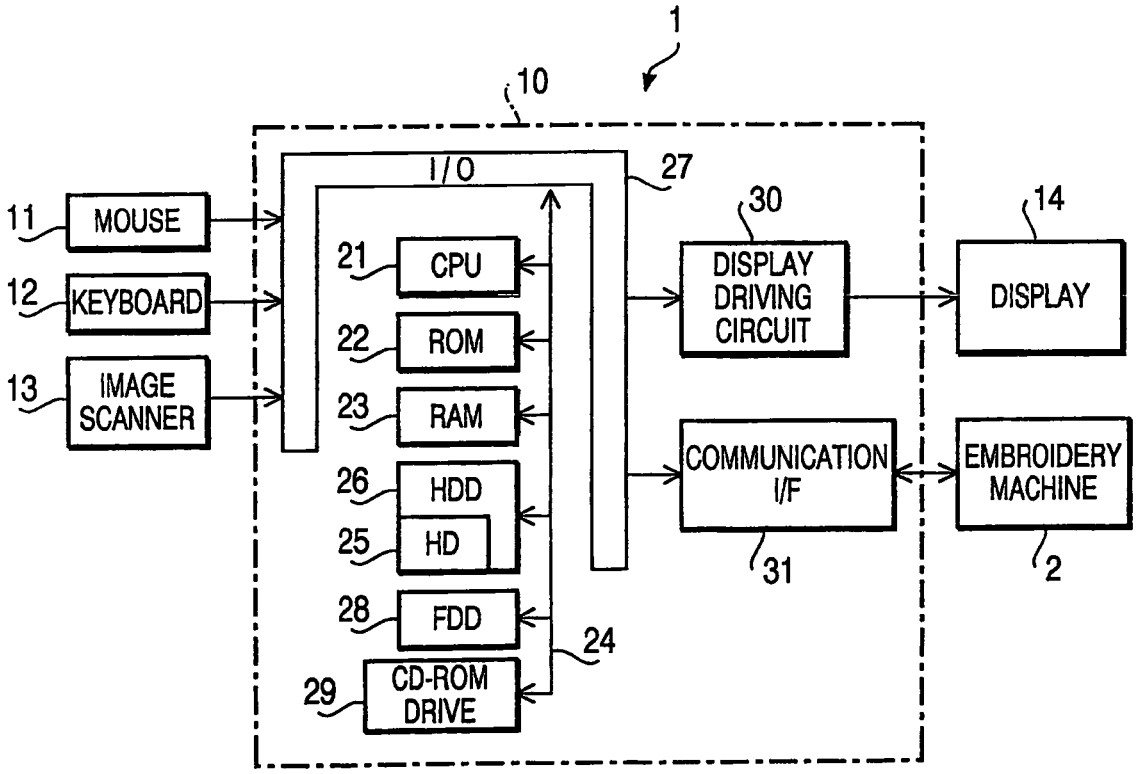
FIG. 2 is a block diagram of an embroidery data processing device provided in the embroidering and printing system shown in FIG. 1.

FIG. 2 is a block diagram of the embroidery data processing device 1 which is constituted by a personal computer. As shown in FIG. 2, the embroidery data processing device 1 includes a control unit 10, a mouse 11 connected to the control unit 10, a keyboard 12, an image scanner 13 and a display 14. The control unit 10 includes a microcomputer having a CPU (central processing unit) 21, a ROM 22, and a RAM 23, which are connected to each other via a bus 24. The controller 10 further includes a hard disk drive (HDD) 26 having a hard disk (HD) 25 and an input/output (I/O) interface 27.

A flexible disk drive (FDD) 28 and a CD-ROM drive 29 are also connected to the bus 24. The mouse 11, the keyboard 12, the image scanner 13, a display driving circuit 30 for driving the display 14, and a communication interface 31 interfacing the control unit 10 with the embroidery machine 2 are connected to the I/O interface 27.

In the ROM 22, various types of programs, such as a start up program for starting up the personal computer (the embroidery data processing device 1), are stored. In the RAM 23, an image data memory area for storing image data of printing patterns read by the image scanner 13 or read from a flexible disk or a CD-ROM, an embroidery data memory area for storing embroidery data of embroidery patterns, areas for storing results of calculating operations of the CPU 21, buffer areas, pointer areas, counter areas, and the like are allocated, and these areas are used on an as needed basis.

In the hard disk 25, an operating system, drivers for the mouse 11, keyboard 12, the image scanner 13 and the display 14, application programs and the like are stored. A control program for obtaining image data or embroidery data from the image scanner 13, the flexible disk, or the CD-ROM, a data input/output control program for storing the image data or the embroidery data in the image data memory area or the embroidery data memory area, a control program for embroidery data processing are also stored in the HDD 26 (see FIG. 5). Print data or embroidery data may be stored in the HDD 26.

Figure 3:
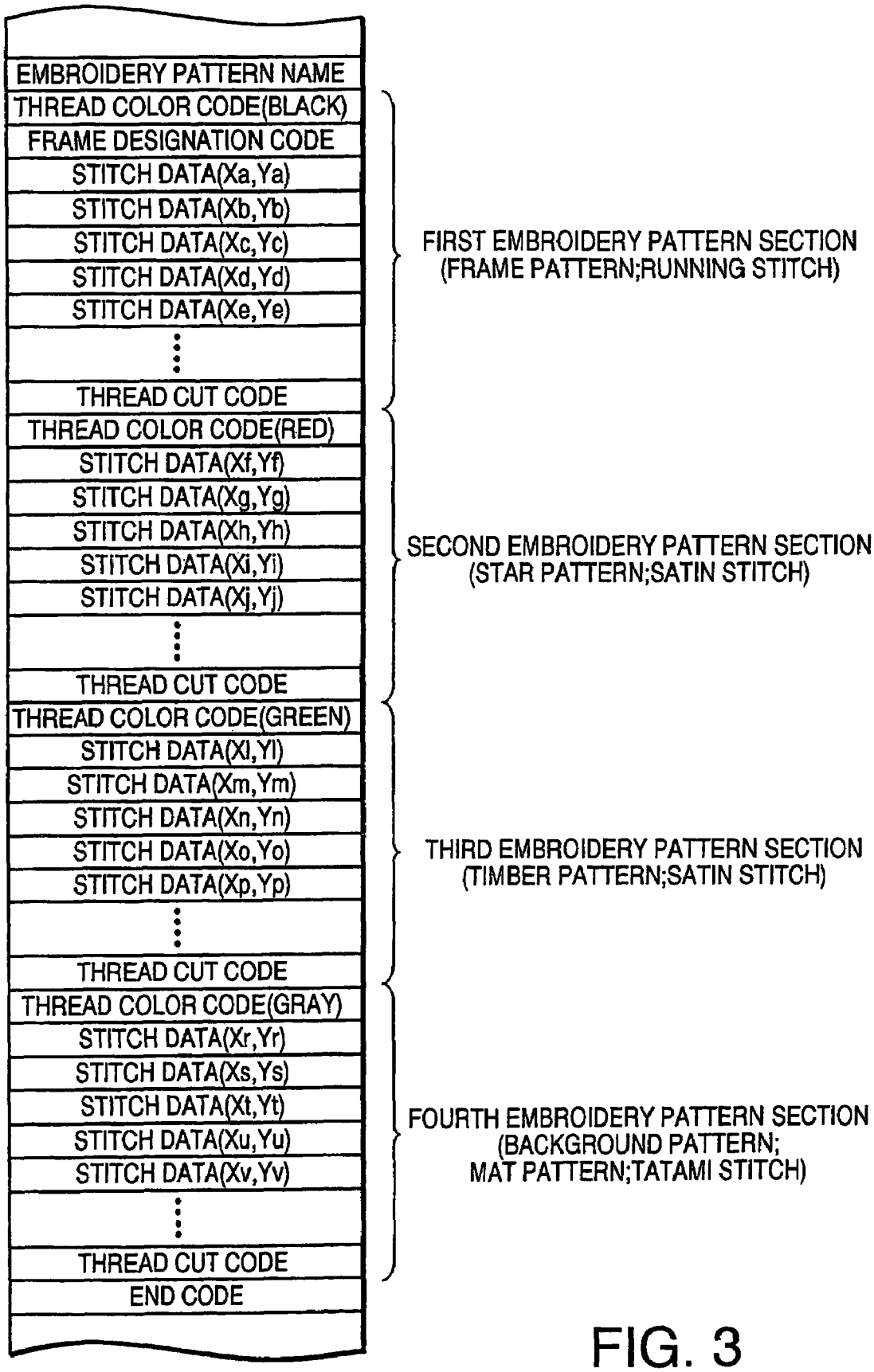
FIG. 3 shows an example of embroidery data of an embroidery pattern shown in FIG. 7.
Figure 7:
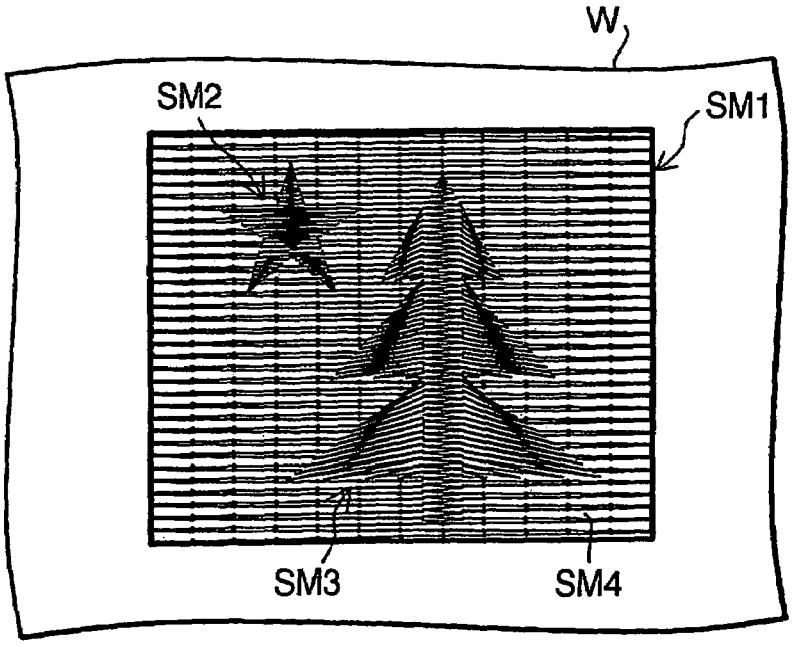
FIG. 7 illustrates an example of an embroidery pattern including a plurality of embroidery regions.

FIG. 3 shows an example of embroidery data of an embroidery pattern shown in FIG. 7. The embroidery data shown in FIG. 3 is used by the embroidery machine 2 for embroidering. As shown in FIG. 3, the embroidery data of FIG. 7 includes four (first to fourth) embroidery pattern sections SM1 to SM4. The first embroidery pattern section SM1 is a frame pattern to be formed by running stitch for forming a rectangular outer frame in a dark color, the second embroidery pattern section SM2 is a star pattern to be formed by satin stitch in a red color, the third embroidery pattern section SM3 is a timber pattern to be formed by satin stitch in a green color, and the fourth embroidery pattern section SM4 is a background pattern to be formed by tatami stitch in a gray color.

More specifically, each of the embroidery pattern sections SM1 to SM4 includes stitch data of a relative coordinate representing a moving amount (of fabric) between a current stitch to a next stitch. Further, each of the embroidery pattern sections SM1 to SM4 has a thread color code at its top portion, and a thread cut code at its bottom portion. Only the first embroidery pattern section SM1 has a frame designation code for defining a frame pattern at its forefront.

Figure 4:
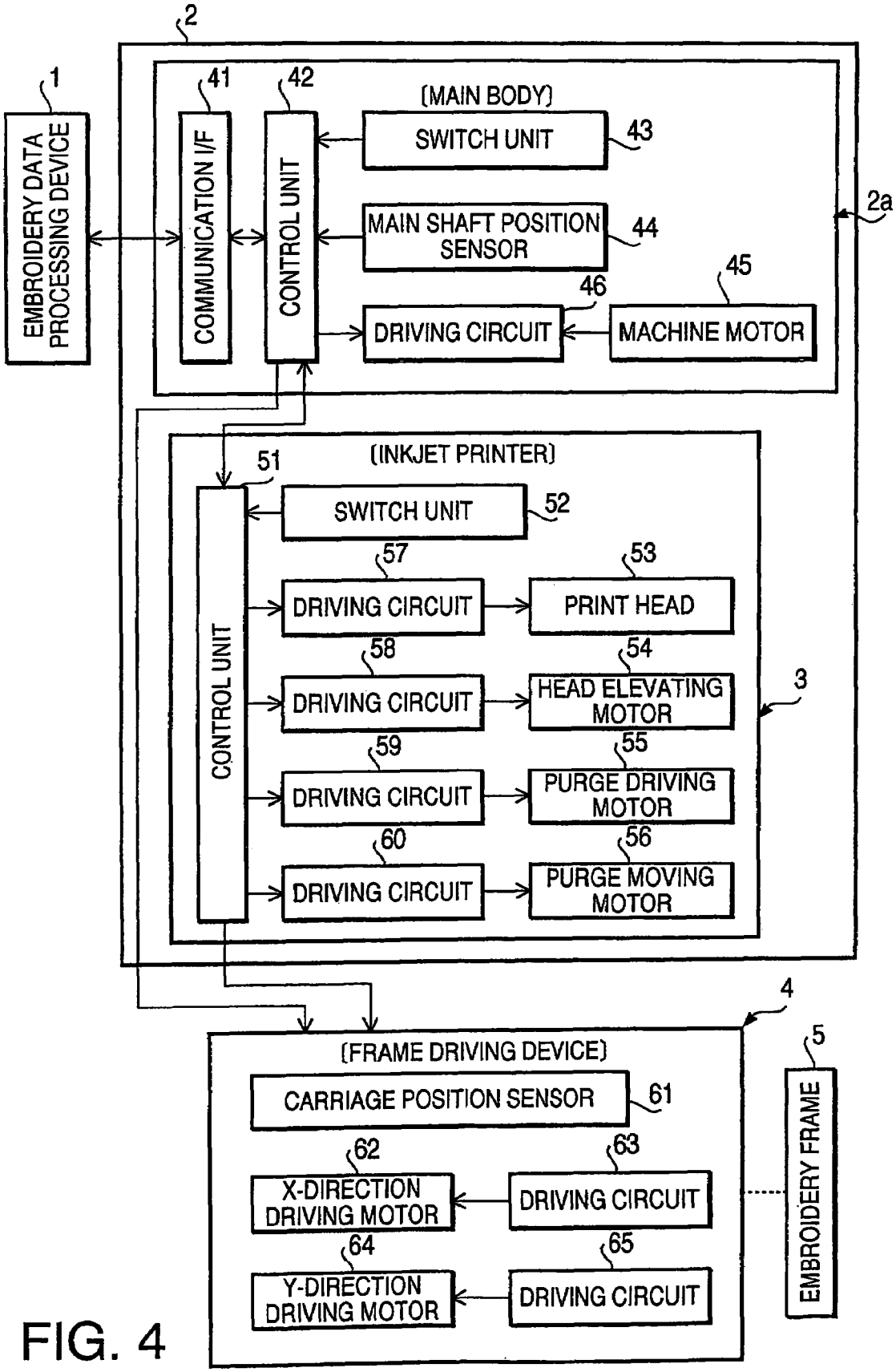
FIG. 4 shows a block diagram of an embroidery machine provided in the embroidering and printing system shown in FIG. 1.

As shown in FIG. 4, the embroidery machine 2 includes a main body 2*a*. The main body 2*a* includes a communication interface (I/F) 41, a control unit 42, a switch unit 43 having various types of switches, a main shaft position sensor 44, a machine motor 45 and a driving circuit 46 for the machine motor 45. The control unit 42 is connected to the embroidery data processing device 1 via the communication I/F 41. By rotations of the machine motor 45, a main shaft (not shown) is rotated. The rotations of the main shaft cause a needle bar up-and-down driving mechanism (not shown) to move a needle bar up and down. By cooperation of the up and down movement of a sewing needle of the needle bar and a thread taker mechanism (not shown) provided in a bed portion, embroidery stitches are formed on fabric W held by the embroidery frame 5.

The inkjet printer 3 includes a control unit 51, a switch unit 52 having various types of switches, a print head 53 in which nozzles for four colors (cyan, magenta, yellow and black) are arranged in four rows, a head elevating motor 54, a purge driving motor 55, a purge moving motor 56, driving circuits 57, 58, 59 and 60 provided for the print head 53, the head elevating motor 54, the purge driving motor 55 and the purge moving motor 56, respectively. When the print head 53 receives a print command from the control unit 51, the print head 53 operates to eject ink downwardly to the fabric W through use of deformation of a piezoelectric ceramic actuator.

The frame driving device 4 includes a carriage position sensor 61, an x-direction driving motor 62 for moving the embroidery frame 5 in an x-direction, a y-direction driving motor 64 for moving the embroidery frame 5 in a y-direction, driving circuits 63 and 65 provided for the x-direction driving motor 62 and the y-direction driving motor 64, respectively. When the frame driving device 4 receives a frame movement command signal from the control unit 42 of the main body 2*a* of the embroidery machine 2 or the control unit 51 of the inkjet printer 3, the frame driving device 4 drives the x-direction motor 62 and the y-direction motor 64 to move the embroidery frame 5 in the x and y directions.

Hereafter, control routines for embroidery data to be executed by the control unit 10 of the embroidery data processing device 1 will be explained with reference to flowcharts of FIGS. 5 and 6. In the following, "Si" (i=11, 12,13, . . . ) represents the number of each step.

When an operator selects an "embroidery data processing" from a main menu displayed on the display 14, control of the embroidery data processing is started and a setting screen for stitch attributes to be targeted for printing is displayed on the display 14 as shown in FIG. 9 (S11). The operator sets each of the stitch attributes including "stitch form", "thread color", "pattern form" as well as "print form" through the setting screen (S12).

For example, the operator selects one or more of items of "tatami stitch", "running stitch" and "satin stitch" as the stitch form, selects one or more of items of"frame", "letter" and "design" as the pattern form, and selects one of items of "stitch printing" and "filling" as the print form.

Next, in S13, an embroidery pattern section counter SC is initialized (i.e., set to "1"). In S14, data of the embroidery pattern section corresponding to the counter SC is obtained from the embroidery data selected in advance (S14). Next, the control unit 10 judges whether division into embroidery regions based on the stitch attributes is designated in S12. Specifically, if the division into embroidery regions is designated by the stitch form (by selection of one or more of the tatami stitch, satin stitch and running stitch) (S15: YES), control proceeds to S20 where an embroidery region division control process by a stitch form is executed.

In the an embroidery region division control process by the stitch form (S20), the following process for analyzing the stitch form (hereafter, referred to as a stitch form analyzing process) is executed. As explained below, the stitch form analyzing process is executed for determining which of the satin stitch, the tatami stitch and the running stitch the embroidery data designated by the counter SC contains. First, variables Pi (i=1,2, . . . ,n) are assigned to needle drop points (the total number of needle drop points is n) contained in the embroidery data, respectively. An initial value 1 is assigned to the variable i. An orthogonal coordinate system is set for each of the needle drop points (i.e., each orthogonal coordinate system has an origin point Pi).

As shown in FIGS. 8A and 8B, the x-axis is set along a line extending from a needle drop point (the origin point) Pi to a needle drop point $P_{i+1}$, and y-axis is set along a line obtained by rotating counterclockwise the x-axis by 90°. Then, a coordinate ($X_{i+1}$, 0) of the needle drop point $P_{i+1}$ and the coordinate ($X_{i+2}$, $Y_{i+2}$) of the needle drop point $P_{i+2}$ are read out from the embroidery data, and are stored in a coordinate memory area in the RAM 23.

Next, the values of $X_{i+1}$ and $X_{i+2}$ are compared with each other. If $X_{i+1}$ is greater than $X_{i+2}$, the attribute of the needle drop point $P_{i+1}$ is defined as a tentative contour point. If $X_{i+2}$ is greater than or equal to $X_{i+1}$ ($X_{i+2} \geqq X_{i+1}$), the attribute of the needle drop point $P_{i+1}$ is defined as a tentative running stitch point. If the needle drop point $P_{i+1}$ is a contour point as shown in FIG. 8A, turning back is caused in regard to the stitches $S_i$ and $S_{i+1}$. In this case, $X_{i+2}$ is smaller than $X_{i+1}$ ($X_{i+2} < X_{i+1}$). In this case, the attribute of the needle drop point $P_{i+1}$ can be assumed to be a contour point, and therefore the needle drop point $P_{i+1}$ is defined as a tentative contour point.

If the needle drop point $P_{i+1}$ is a running stitch point, $X_{i+2}$ is greater than or equal to $X_{i+1}$ ($X_{i+2} \geqq X_{i+1}$) as shown in FIG. 8B. In this case, the needle drop point $P_{i+1}$ can be assumed to be a running stitch point and therefore the attribute of the needle drop point $P_{i+1}$ is defined as a tentative running stitch point. Attributes of tentative running stitch points are assigned to needle drop points $P_1$ and Pn.

The above mentioned process is executed repeatedly while the variable i is incremented. In the state where (i+1) reaches n, all of the needle drop points (i+1=2 to n-1) have been assigned attributes of tentative contour points or tentative running stitch points.

Next, the stitch forms are categorized as follows. First, the control unit 10 judges whether a needle drop point $P_{i+1}$ is assigned the attribute of the tentative contour point while assigning 1, 2, 3 . . . to the variable i. If $P_{i+1}$ is a tentative running stitch point, the control unit 10 assigns a next greater value to the variable i and repeats the above judgment. If $P_{i+1}$ is the tentative contour point, the control unit 10 judges whether the needle drop point $P_{i+1}$ adjoins to a needle drop point having the attribute of the tentative running stitch point (i.e., judges whether one of the needle drop points $P_i$ and $P_{i+2}$ is the tentative running stitch point). If the point $P_{i+1}$ adjoins to a point having the attribute of the tentative running stitch point, $Y_{i+2}$, which has been saved in the process in which the tentative contour point attribute is assigned to the needle drop point $P_{i+1}$, is read out.

If signs of $Y_{i+2}$ obtained in a like manner for the needle drop points of the tentative contour point located on the front or rear side of the point $P_i$ are different from each other, a tentative tatami contour is assigned to the stitch attribute of the needle drop point $P_{i+1}$. If signs of $Y_{i+2}$ obtained in a like manner for the needle drop points of the tentative contour point located on the front or rear side of the point $P_i$ are equal to each other, a tentative running stitch is assigned to the stitch attribute of the needle drop point $P_{i+1}$.

If the needle drop point $P_{i+1}$ does not adjoin to a needle drop point of the tentative running stitch point and signs of $Y_{i+2}$ between the front and rear tentative contour points are replaced with each other, the needle drop point $P_{i+1}$ is assigned a tentative satin contour. On the other hand, signs of $Y_{i+2}$ between the front and rear tentative contour points are not replaced with each other, an attribute of a tentative running stitch point is assigned to the needle drop point $P_{i+1}$.

Finally, shapes, thread densities, tatami patterns, and etc. of needle drop points located at the front and rear sides of each of the needle drop points assigned the attribute of the tentative tatami contour are obtained, and a process for fixing a contour of an embroidery region of the tatami stitch is executed using the obtained data. Shapes, thread densities, and etc. of needle drop points located at the front and rear sides of each of the needle drop points assigned the attribute of the tentative satin contour are obtained, and a process for fixing a contour of an embroidery region of the satin stitch is executed using the obtained data. Then, a process for fixing the needle drop points, which are not defined as the tentative tatami contour attribute and the tentative satin contour attribute, as an embroidery region of the running stitch is executed.

Referring back to FIG. 5, if the judgment result of S15 is NO or after S20 is finished, control proceeds to S16 where the control unit 10 judges whether the division into embroidery regions is designated by the thread color. If the division into embroidery regions is designated by the thread color (S16: YES), control proceeds to S21 where an embroidery region division control process by the thread color is executed. In the embroidery region division control process by the thread color, the thread color code contained in the top of the embroidery pattern section corresponding to the counter SC is searched for. If the thread color code corresponding to a designated color is contained in the embroidery pattern section the embroidery region of the embroidery pattern section corresponding to the counter SC is separated from the other embroidery regions. Then, control proceeds to step S17.

If the judgment result of S16 is NO or after S21 is finished, control proceeds to S17 where the control unit 10 judges whether the division into embroidery regions is designated by the pattern form. If the division into embroidery regions is designated by the pattern form (S17: YES), control proceeds to S22 where an embroidery region division control process by the pattern form is executed. In the embroidery region division control process by the pattern form, a pattern form designation code (a frame designation code, a letter designation code, a design designation code, and etc.) contained in the top of the embroidery pattern section corresponding to the counter SC is searched for. If a pattern form code corresponding to the designated pattern form is contained in the embroidery pattern section SM, an embroidery region of the embroidery pattern section corresponding to the counter SC is separated from the other embroidery regions. Then, control proceeds to S18 where the control unit 10 judges whether the embroidery pattern section corresponding to the counter SC is the last.

If the embroidery pattern section corresponding to the counter SC is not the last (S18: NO), the counter SC is incremented by 1 (S19). Then, control returns to S14. If all of the embroidery pattern sections SMs in the embroidery data have been processed (i.e., the target embroidery pattern section is the last) (S18:YES), control proceeds to S23 where a print target embroidery region designation process shown in FIG. 6 is executed.

In the print target embroidery region designation process, the presence or absence of the embroidery region divided by S20, S21 and S22 is detected (S31). If the divided embroidery region of the stitch attribute is not found (S32: NO), a division flag BF is reset (S36). If the divided embroidery region of the stitch attribute is found (S32: YES), the division flag BF is set (S33). Then, the embroidery pattern section SM is subjected to a block forming process, by which the divided blocks are displayed (S34).

The block forming process will be explained. In general, in embroidery data of an embroidery pattern section SM, the embroidery pattern section SM can be divided into one or more polygonal blocks, such as a triangle, trapezium and rectangle, and embroidery data is prepared for each of the blocks. Then, each of the pieces of embroidery data of the blocks are linked to one another in sequence. Therefore, it is possible to obtain shapes and the number of blocks of the blocks constituting the embroidery pattern section SM by analyzing the embroidery data.

The shapes of the blocks obtained as above are displayed at proper positions on the display 14 according to the embroidery data. Then, a process for designating a print target block in which an operator is allowed to designate, through use of a pointing device (i.e., the mouse 11), a block to be printed is executed (S35). Then, the print target embroidery region designation process terminates.

Referring back to FIG. 5, if the division flag BF is not set (i.e., the divided embroidery regions are not found) (S24: NO), the embroidery data processing of FIG. 5 terminates. If the division flag BF is set (i.e., the divided embroidery regions are found) (S24: YES), print data is generated for each of all of the divided embroidery regions, according to the designated print form (S25).

Finally, the pieces of embroidery data for all of the embroidery regions designated as the print target are deleted (S26). Then, the embroidery data processing of FIG. 5 terminates. Meanwhile, if embroidery regions to be targeted for embroidering are found on both sides of an embroidery region designated as a print target at the late stage, a thread cut command for instructing a thread cut mechanism (not shown) to perform thread cut is added to the bottom of the embroidery data belonging to the embroidery region which is to be subjected to the embroidering just before the printing of the embroidering data of the print target, so that occurrence of jump stitch (linking the embroidery regions sandwiching the print target region therebetween) can be prevented.

Hereafter, the process for generating print data (a print data generating process) will be explained. With regard to the stitch printing, print data of needle drop points derived based on coordinates of all of the needle drop points, and print data of the stitch lines corresponding to stitches between a needle drop point to a next needle drop point are obtained by calculation.

With regard to the filling, an embroidery region of the embroidery pattern section SM defined in the embroidery data are obtained, and data of a dot pattern to be printed (using drops of ink) over the entire embroidery region in a form of a grid of dots is obtained by calculation.

Hereafter, operations and advantages of the above mentioned embodiment will be explained. After an operator selects an item "embroidery data processing" from the main menu displayed on the display 14, the setting screen of "stitch attribute setting for printing" is displayed. Then, the operator designates "satin sewing" as the stitch form and "stitch printing" as the print form so as to designate the embroidery region for which the printing is executed in place of the embroidering.

After setting the stitch attribute, the analyzing process is executed for each of the first to fourth embroidery pattern sections SM1 to SM4 shown in FIG. 7, and the second embroidery pattern section SM2 (having a star pattern) and the third embroidery pattern section SM3 (having a timber pattern), each of which is to be embroidered by the satin sewing, are designated as the print target embroidery regions.

Figure 10:
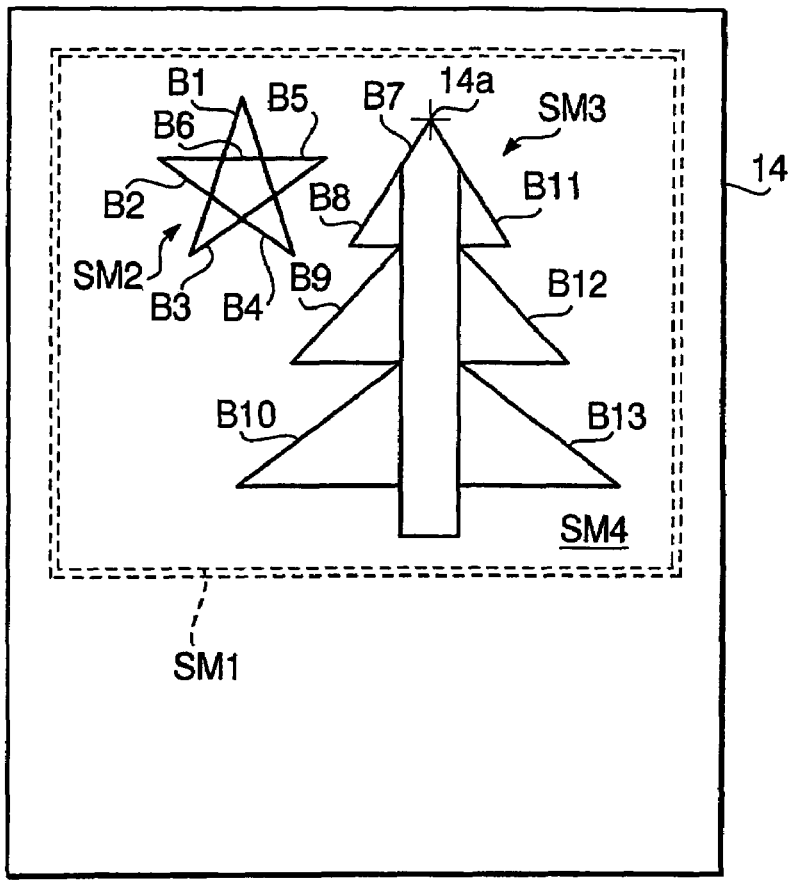
FIG. 10 illustrates an example of onscreen representation of an embroidery pattern in which each embroidery region is divided into one or more blocks.
Figure 11:
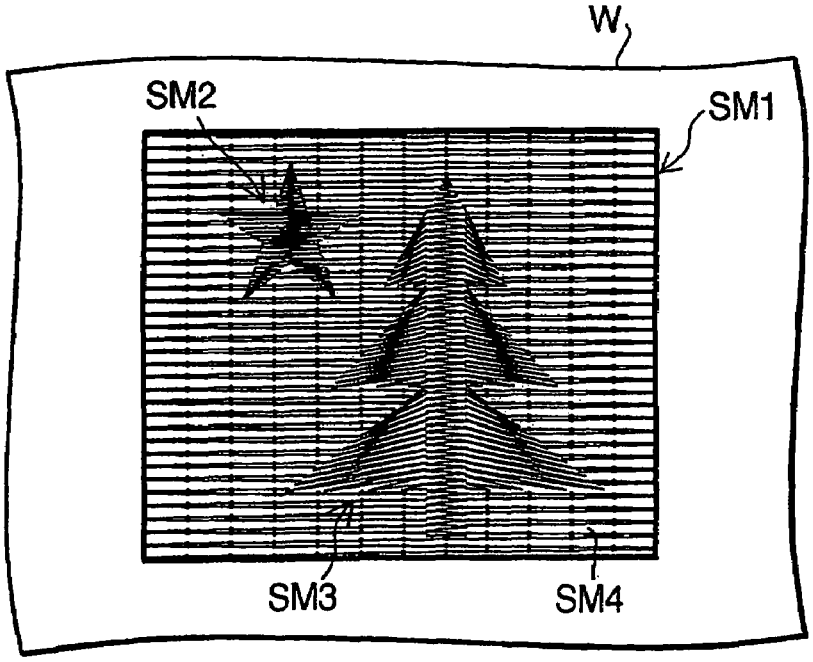
FIG. 11 illustrates an example of a design formed as a combination of embroidery and printing.

As shown in FIG. 10, the second embroidery patter section SM2 is divided into six blocks B1 to B6, each of which is represented by a solid line, and the third embroidery pattern section SM3 is divided into seven blocks B7 to B13, each of which is represented by a solid line. Each of the remaining embroidery pattern sections (SM1 and SM4) is represented by a dashed line.

If the operator designates the block B7 having a longer size in a longitudinal direction by a pointer 14*a*, only the embroidery data of the block B7 of embroidery regions in the third embroidery pattern section SM3 is deleted, and then the print data is generated.

When the embroidering and printing process is executed, each of the first to fourth embroidery pattern sections SM1 to SM4 is embroidered on the fabric W, which is held on the embroidery frame 5, by the embroidery machine 2 based on the embroidery data. With regard to the block B7 of the third embroidery pattern section SM3, the printing process is executed on the fabric W by the inkjet printer 3 based on the print data of the stitch pattern generated as mentioned above.

Consequently, an embroidering operation is performed for the frame pattern of the first embroidery region, the star pattern of the second region, the timber pattern of the third embroidery pattern region excepting the block B7, and the background pattern of the fourth embroidery region by using black embroidery thread, red embroidery thread, green embroidery thread, and the gray embroidery thread, respectively. Only the block B7 of the third embroidery pattern section SM3 is subjected to the stitch printing by using green color ink.

Figures 12, 13:
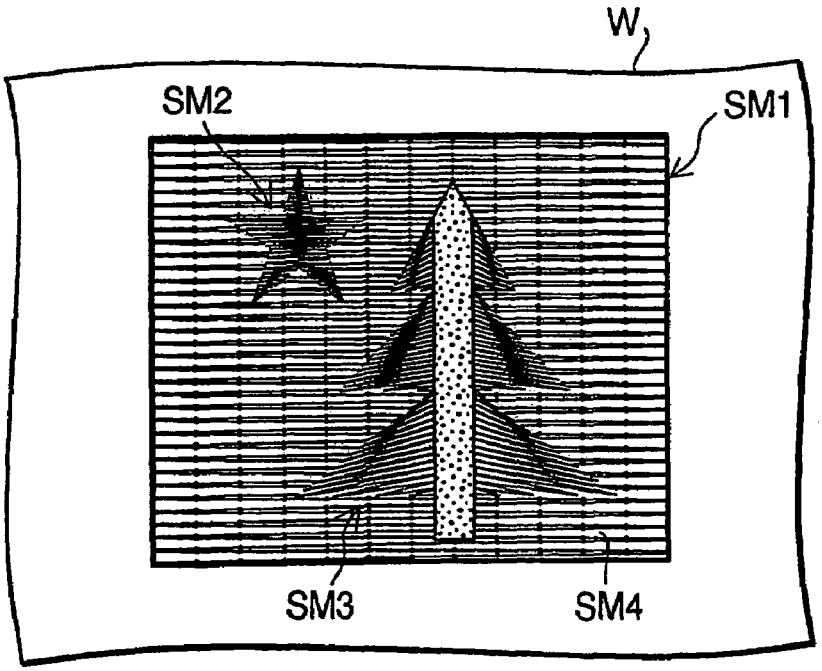
FIG. 12 illustrates another example of a setting screen for stitch attributes to be targeted for printing.
FIG. 13 illustrates another example of a design formed as a combination of embroidery and printing.

If the operator designates "satin stitch" for the "stitch form", and "filling" for "print form" on the setting screen of "stitch attribute setting for printing" as shown in FIG. 12, only the block B7 of the third embroidery pattern section SM3 is filled with green color ink.

As described above, according to the embodiment, an operator is allowed to designate a desired one of embroidery regions which are obtained by dividing in advance embroidery data into embroidery regions in a predetermined dividing scheme. The printing operation is performed only for the embroidery region designated by the operator. That is, the operator is able to print only the desired one of embroidery regions on the fabric. It is understood that both of goodness of embroidering and goodness of printing can be represented on fabric, and therefore fabric on which texture, stereoscopic effect and the sense of gorgeous are suitably represented can be obtained.

Since only the print target region is subjected to the printing operation, consumption of ink can be suppressed to the minimum, and a finishing time for finishing the fabric can be reduced considerably because a printing speed is faster than an embroidering speed.

Since embroidery regions are divided by the stitch attribute of the stitch form including the "running stitch", "satin stitch" and "tatami stitch" (S20), the operator is able to designate a desired embroidery region to be subjected to the printing operation according to the stitch attribute of the stitch form. Therefore, an operation for designating the embroidery region to be subjected to the printing operation by the stitch form can be eased.

Since embroidery regions are divided by the stitch attribute of the thread color (S21), embroidery regions are categorized so that the operator is able to designate a desired embroidery region to be subjected to the printing operation according to the stitch attribute of the thread color. Therefore, an operation for designating the embroidery region to be subjected to the printing operation by the thread color can be eased.

It is also possible to designate the embroidery region to be subjected to the printing operation by a pattern form, an operation for designating the embroidery region by a stitch form can be eased.

Since each of the embroidery pattern sections is divided into blocks by steps of S34 to S35 in the print target embroidery region designation process, the operator is able to designate a block to be targeted for the printing, for each of embroidery regions divided by the stitch form or the thread color. Therefore, the degrees of freedom regarding designation of a size of a print target region can be enhanced.

Since the operator is allowed to designate one of embroidery regions divided according to one or more of criterions including the stitch form, thread color and the pattern form, flexibility can be attained in regard to designation of a region to be printed. Therefore, the degrees of freedom regarding designation of a print target region can be enhanced.

Since print data for printing stitches connecting sequentially needle drop points corresponding to stitches embroidered on fabric by the embroidery machine 2 is generated in step S25, a printed image like real embroidery stitches can be obtain, and therefore representation of texture of embroidery stitches by printing can be enhanced.

Figure 5:
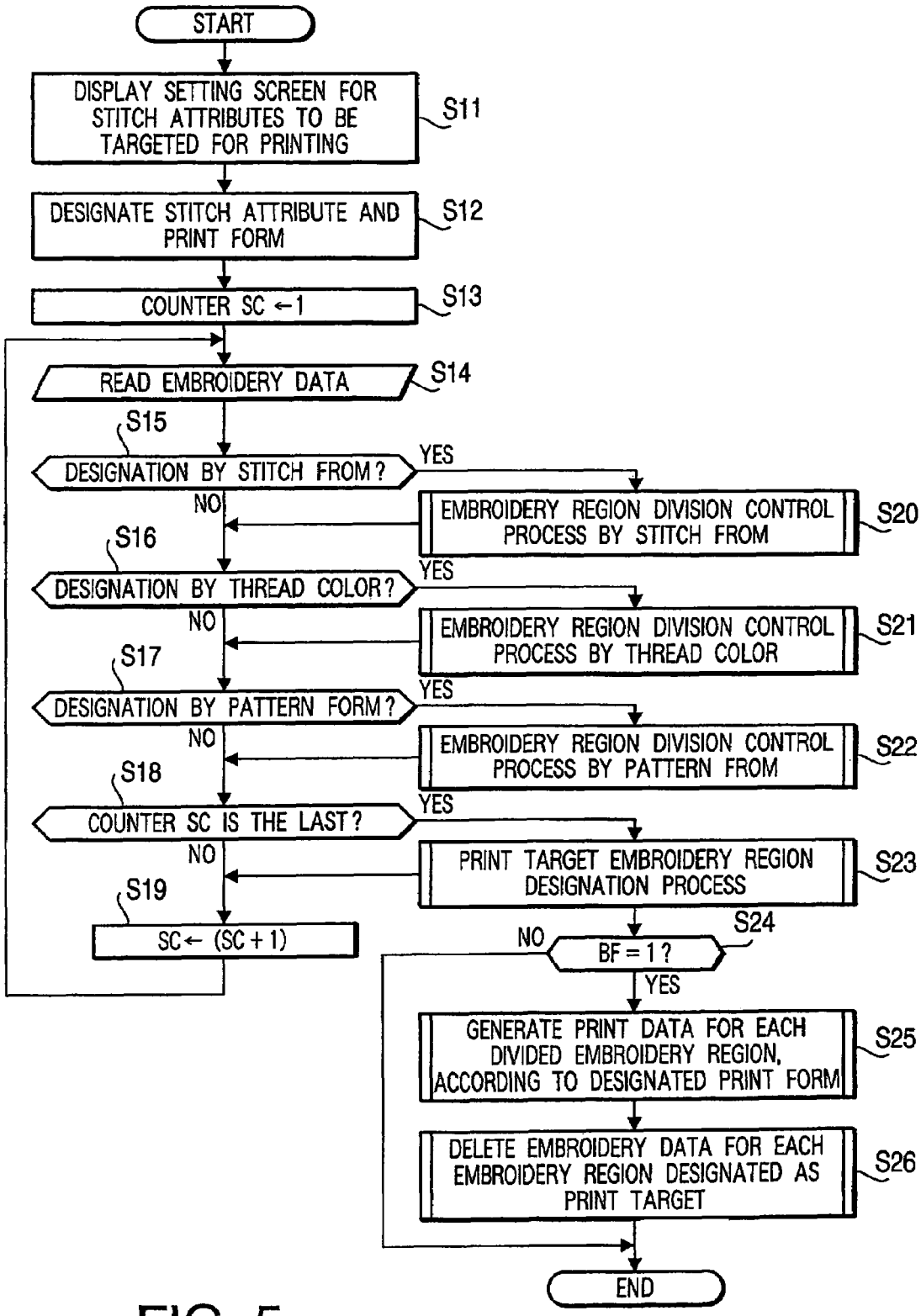
FIG. 5 is a flowchart illustrating embroidery data processing executed by the embroidery data processing device according to the first embodiment.
Figure 6:
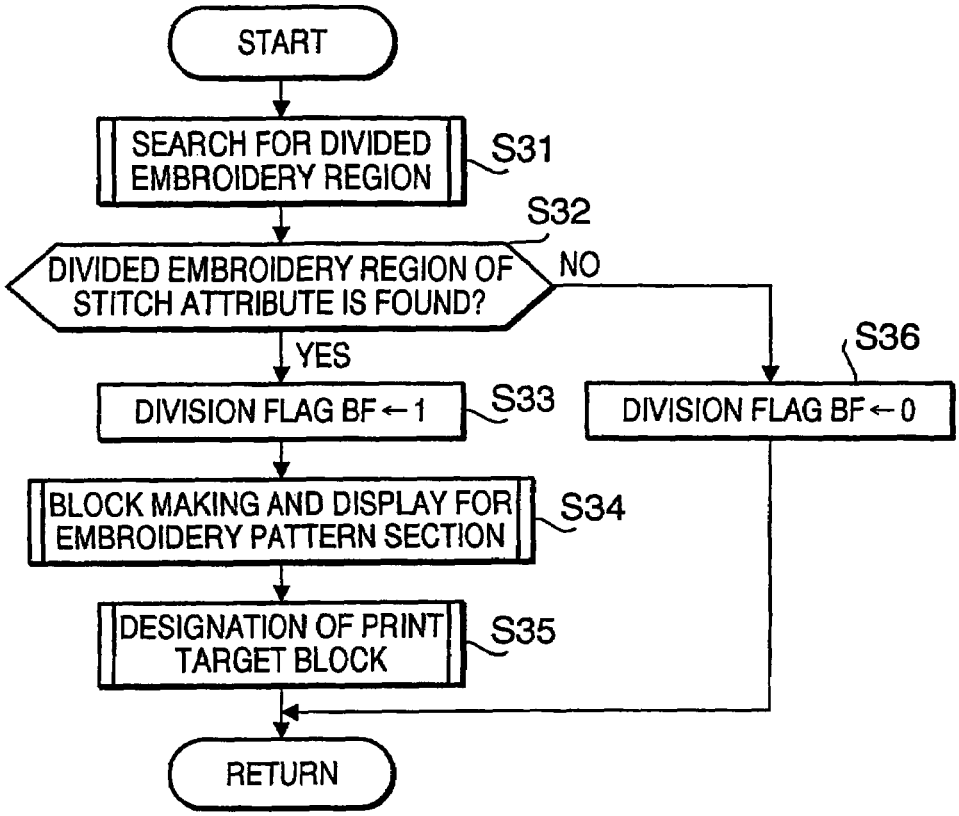
FIG. 6 is a flowchart illustrating a print target embroidery region designation process executed by the embroidery data processing device according to the first embodiment.

Print data for filling the designated embroidery region is also obtained by step S25 of FIG. 5, the filling can be attained with regard to the embroidery pattern such as a background which needs to be printed on the entire print target region.

Second Embodiment

Hereafter, a second embodiment of the disclosure will be explained. Since the second embodiment corresponds to a modification of the control routines executed by the embroidery data processing device 1 of the first embodiment, explanations for the second embodiment will be made with reference to FIGS. 1 to 4, and explanations about the configuration of the system 100 will not be repeated.

FIGS. 14 to 17 show embroidery data processing routines according to the second embodiment. When an operator selects an "embroidery data processing" from a main menu displayed on the display 14, control of the embroidery data processing is started and a setting screen for stitch attributes for printing is displayed on the display 14 as shown in FIG. 18 (S111). The operator sets the stitch attributes of "stitch form", "thread color", "pattern form" as well as the "print form" through use of the setting screen (S112).

For example, the operator selects one or more of items of "running stitch", "satin stitch" and "tatami stitch" as the stitch form, selects one or more of items of "frame" "letter" and "design" as the pattern form, and selects one of items of "stitch printing" and "filling" as the print form.

Next, in S113, an embroidery pattern section counter SC is initialized (i.e., set to "1"). In S114, data of the embroidery pattern section SM corresponding to the counter SC is read out from embroidery data selected in advance (S114). Next, the control unit 10 judges whether division into embroidery regions is designated based on the stitch attribute in S112. If the division of the embroidery regions is designated by the stitch form (S115: YES), control proceeds to S120 where an embroidery region division control process by a stitch form (see FIG. 15) is executed.

If the embroidery region division control process is initiated, a stitch form analyzing process for determining which of the satin stitch, the tatami stitch and the running stitch the embroidery data designated by the counter SC contains is executed (S131). Since the explanation about the stitch form analyzing process has been already given referring to FIGS. 8A and 8B in the first embodiment, explanation of the stitch form analyzing process will not be repeated.

Figure 14:
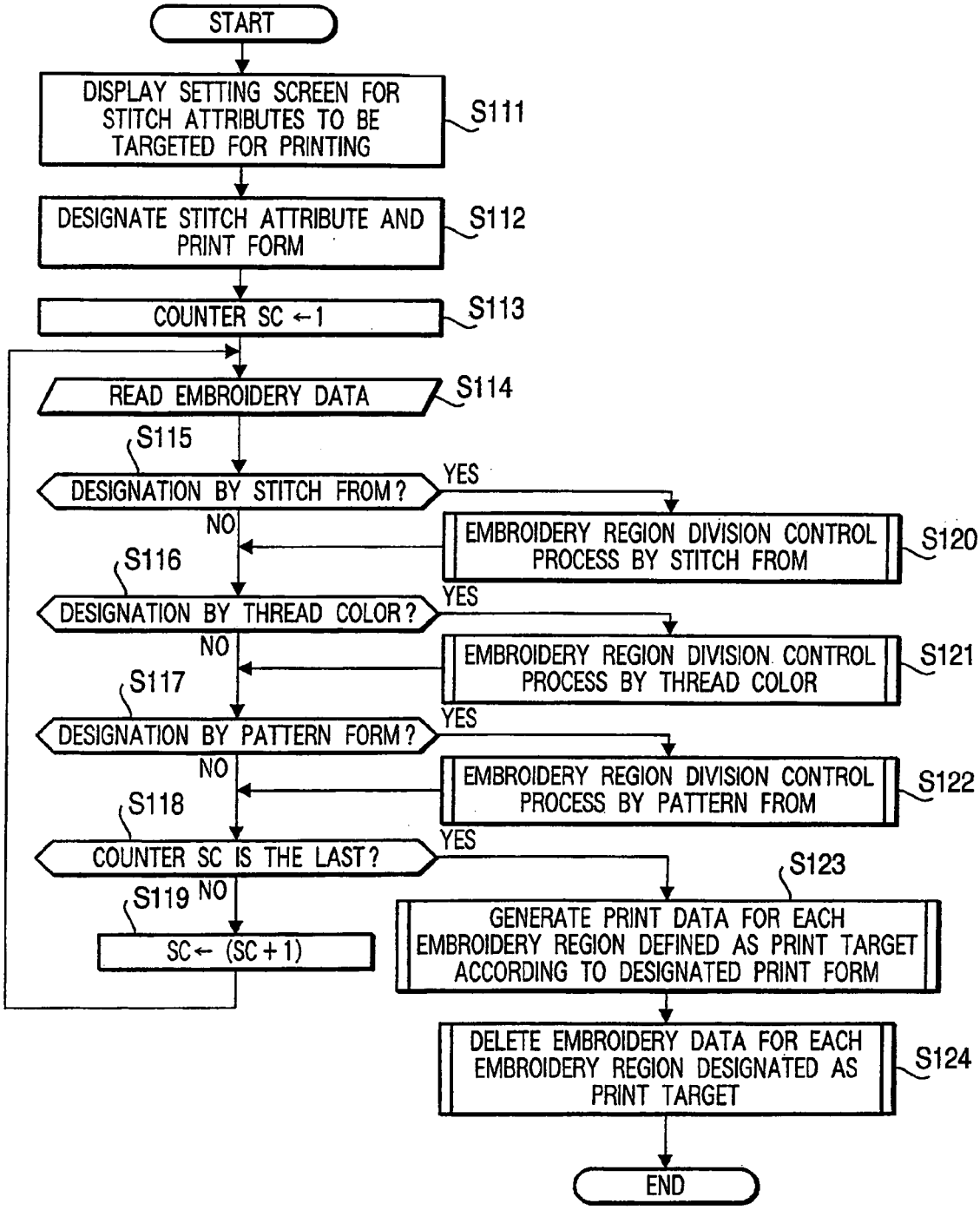
FIG. 14 is a flowchart illustrating embroidery data processing executed by the embroidery data processing device according to the second embodiment.
Figure 15:
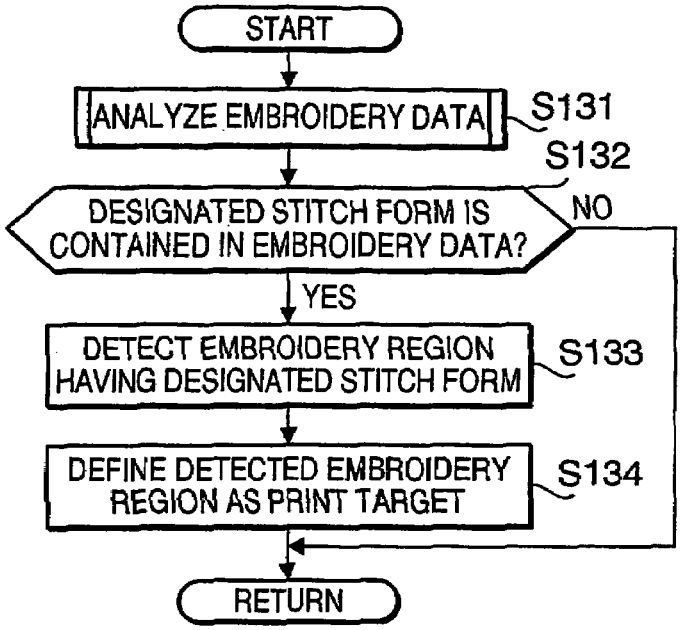
FIG. 15 is a flowchart illustrating an embroidery region division control process by a stitch form.

Referring now to FIG. 15, in step S132, the control unit 10 of the embroidery data processing device 1 judges whether the designated stitch form is contained in the embroidery data. If the designated stitch form is not contained in the embroidery data (S132: NO), the process of FIG. 15 terminates, and control proceeds to step S16 of FIG. 14. If the designated stitch form is contained in the embroidery data (S132: YES), embroidery regions having the designated stitch forms are detected (S133). Then, the detected embroidery regions are defined as a print target (S134). Then, the embroidery region division control process of FIG. 15 terminates.

Figure 16:
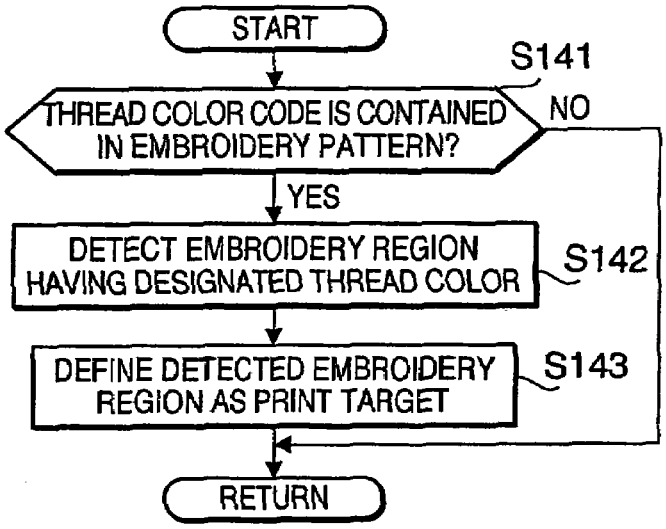
FIG. 16 is a flowchart illustrating an embroidery region division control process by a thread color.

Referring back to FIG. 14, if the print target is designated by the thread color (S116: YES), control proceeds to S21 where an embroidery region division control process by a thread color (FIG. 16) is executed. As shown in FIG. 16, first, the control unit 10 searches the embroidery data for a thread color code contained in the top of the embroidery pattern designated by the counter SC (S141). If the thread color code is not contained in the embroidery pattern designated by the counter SC (S141: NO), the embroidery region division control process terminates.

If the thread color code is contained in the embroidery pattern designated by the counter SC (S141: YES), embroidery regions having the designated thread color are detected (S142). Next, the detected embroidery regions are set as a print target (S143). Then, control proceeds to S117 of the embroidery data processing (FIG. 14).

Referring back to FIG. 14, if the print target is designated by the pattern form (S117: YES), control proceeds to S122 where an embroidery region division control process by a pattern form (FIG. 17) is executed. The term "pattern form" means the type or category of a pattern, such as a letter pattern, design (one point design), and a frame pattern (e.g., a decorative pattern surrounding the letter pattern or the design).

Figure 17:
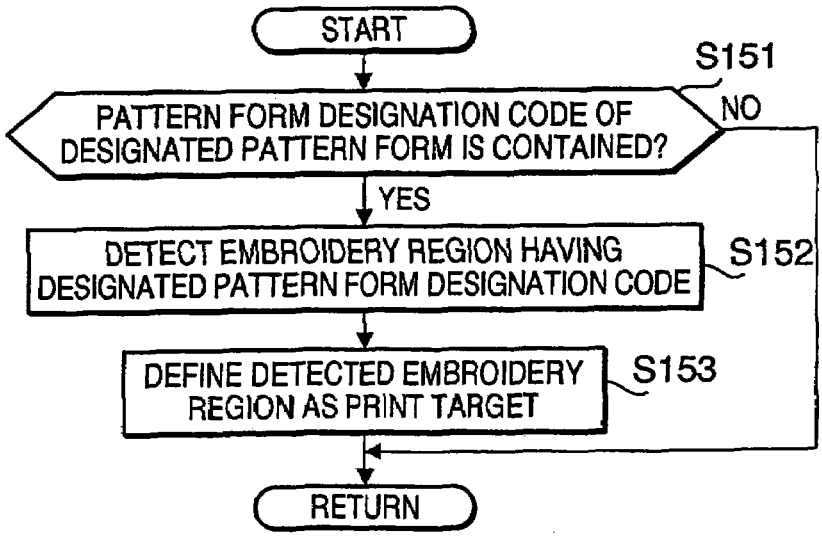
FIG. 17 is a flowchart illustrating an embroidery region division control process by a pattern form.
Figures 18, 19:
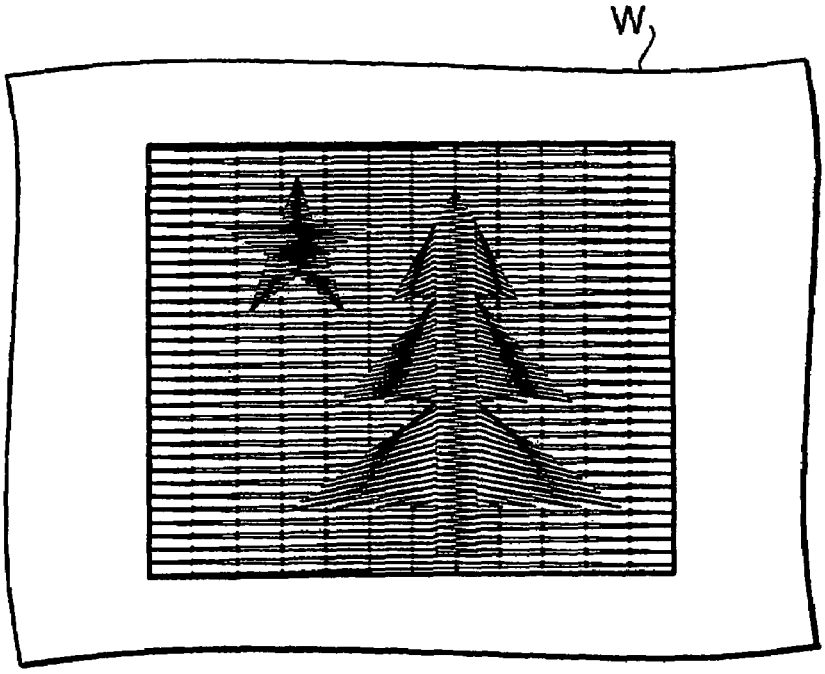
FIG. 18 illustrates an example of a setting screen for stitch attributes to be targeted for printing.
FIG. 19 illustrates an example of a design formed as a combination of embroidery and printing.

Referring now to FIG. 17, first, the control unit 10 searches the embroidery data for a pattern form designation code indicating one of the pattern forms (e.g., a frame designation code, a letter designation code, a design designation code, etc. ) contained at the top of the embroidery pattern designated by the counter SC. If the pattern form designation code corresponding to the designated pattern form is not contained in the embroidery pattern (S151: NO), the embroidery region division control process of FIG. 17 terminates. If the pattern form designation code corresponding to the designated pattern form is contained in the embroidery pattern (S151: YES), embroidery regions having the designated pattern form designation code are detected (S152). Next, the detected embroidery regions are set as a print target (S153). Then, control proceeds to S118 of the embroidery data processing (FIG. 14).

The embroidery pattern section corresponding to the embroidery pattern section counter SC is not the last (S118: NO), the counter SC is incremented by 1 (S119). Then, control returns to S114. If all of the embroidery pattern sections in the embroidery data have been processed (i.e., the processed embroidery pattern section is the last) (S118: YES), control proceeds to S123.

In S123, for each of the embroidery regions defined as a print target, print data is generated according to the established print form. Finally, all of the pieces of embroidery data belonging to the embroidery regions defined as a print target are deleted (S124). Then, the embroidery data processing terminates. Meanwhile, if embroidery regions to be targeted for embroidering are found on both sides of an embroidery region designated as the print target at the late stage, a thread cut command for instructing a thread cut mechanism to perform thread cut is added to the bottom of the embroidery data belonging to embroidery region which is to be subjected to an embroidering process just before a printing process of the embroidering data of the print target, so that occurrence of jump stitch (linking the embroidery regions sandwiching the print target region therebetween) can be prevented.

Hereafter, a print data generating process will be explained. With regard to stitch printing, print data of needle drop points based on coordinates of all of the needle drop points, and print data of stitch lines corresponding to stitches between a needle drop point to a next needle drop point are obtained by calculation.

With regard to the filling, the embroidery region of the embroidery pattern section SM defined in the embroidery data is obtained, and data of a dot pattern to be printed (using drops of ink) over the entire embroidery region in a form of a grid of dots is obtained by calculation.

Hereafter, operations and advantages of the above mentioned second embodiment will be explained. After an operator selects an item "embroidery data processing" from the main menu displayed on the display 14, the setting screen of "stitch attribute setting for printing" is displayed (see FIG. 18). Then, the operator designates "satin sewing" as the stitch form, "red" as the thread color, and "stitch printing" as the print form so as to designate the embroidery area for which the printing operation is executed in place of embroidering.

After setting the stitch attribute, the analyzing process is executed for each of the first to fourth embroidery pattern sections SM1 to SM4 shown in FIG. 7, and the embroidery regions of the fourth embroidery pattern section SM4 (background pattern) of the "tatami stitch", the embroidery regions of the second embroidery pattern section SM2 (having a star pattern) of the "red thread color" are designated as the print target embroidery regions. Then, print data is generated for the embroidery data of the second and fourth embroidery pattern sections, and the embroidery data of the second and fourth embroidery pattern sections is deleted.

When the embroidering and printing process is executed, each of the first and third embroidery pattern sections is embroidered on the fabric W, which is held on the embroidery frame 5, by the embroidery machine 2 based on the embroidery data. With regard to the second and fourth embroidery pattern sections, the printing process is executed on the fabric W by the inkjet printer 3 based on the print data obtained as mentioned above.

Consequently, as shown in FIG. 19, the star pattern of the second embroidery pattern section, the background pattern of the fourth embroidery pattern section are printed on the fabric W with red ink and gray ink, respectively. With regard to the frame pattern of the first embroidery pattern section and the timber pattern of the third embroidery pattern section, the embroidering is performed using the black color thread and the green color thread, respectively.

Figures 20, 21:
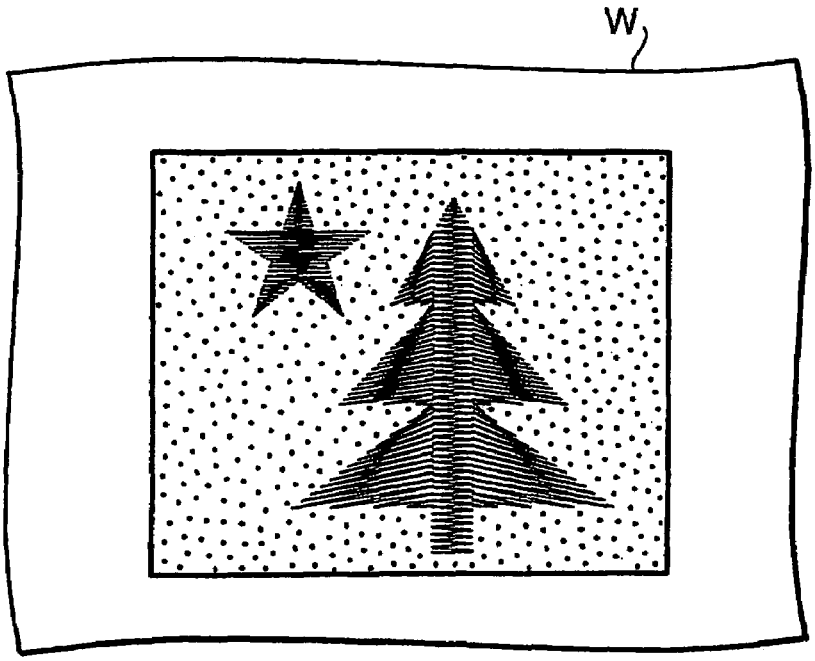
FIG. 20 illustrates another example of a setting screen for stitch attributes to be targeted for printing.
FIG. 21 illustrates another example of a design formed as a combination of embroidery and printing.

If the operator designates "tatami stitch" for the "stitch form", "frame" for the "pattern form" and "filling" for "print form" on the setting screen of"stitch attribute setting for printing" as shown in FIG. 20, the frame pattern of the first embroidery pattern section and the background pattern of the fourth embroidery pattern section are printed with the black ink and gray ink, respectively, and the star pattern of the second embroidery pattern section and the timber pattern section of the third embroidery pattern section are embroidered with the black thread and the green thread, respectively.

As described above, according to the embodiment; an operator is allowed to designate a desired one of embroidery regions which are obtained by dividing in advance the embroidery data into embroidery regions (to be subjected to an embroidering operation using embroidery data) in a predetermined dividing scheme. The printing operation is performed only for the embroidery region designated by the operator. That is, the operator is able to print only the desired one of embroidery regions on the fabric. It is understood that both of goodness of embroidering and goodness of printing can be represented on fabric, and therefore fabric on which texture, stereoscopic effect and the sense of gorgeous are suitably represented can be obtained.

Since only the print target region is subjected to the printing operation, consumption of ink can be suppressed to the minimum, and a finishing time for finishing the fabric can be reduced considerably because a printing speed is faster than an embroidering speed.

Since embroidery regions are divided by the stitch attribute of the stitch form including the "running stitch", "satin stitch" and "tatami stitch" (S120), the operator is able to designate a desired embroidery region to be subjected to the printing operation according to the stitch attribute of the stitch form. Therefore, an operation for designating the embroidery region to be subjected to the printing operation by the stitch form can be eased.

Since embroidery regions are divided by the stitch attribute of the thread color (S121), embroidery regions are categorized in such a manner that the operator is able to designate a desired embroidery region to be subjected to the printing operation according to the stitch attribute of the thread color. Therefore, an operation for designating the embroidery region to be subjected to the printing operation by the thread color can be eased.

Since the operator is allowed to designate one of embroidery regions divided according to one or more of criterions including the stitch form, thread color and the pattern form, flexibility can be attained in regard to designation of a region to be printed. Therefore, the degrees of freedom regarding designation of a print target region can be enhanced.

Since print data for printing stitches connecting sequentially needle drop points corresponding to stitches embroidered on fabric by the embroidery machine 2 is generated, print like real embroidery stitches can be obtain, and therefore representation of texture of embroidery stitches by printing can be enhanced.

Print data for filling the designated embroidery region is also obtained by step S123 of FIG. 14, the filling can be attained with regard to the embroidery pattern such as a background which needs to be printed on the entire print target region.

Since the embroidery data belonging to the embroidery regions of the print target is deleted by step S124 of the embroidery data processing, execution of embroidering for the print target embroidery regions is avoided. Therefore, duplication of printing and embroidering can be avoided reliably, and therefore reduction in finishing time and in ink consumption can be attained.

Although the present disclosure has been described in considerable detail with reference to certain preferred embodiments thereof, other embodiments are possible.

In the embroidery data processing (FIG. 5), each of embroidery attributes including a pitch of an embroidery stitch (the length of a stitch), an angle between a reference line and a direction of a stitch, a thread density, a sewing area, the number of stitch needles (a sewing time) and a relationship between overlapping embroidery patterns in a vertical direction is made settable, and the decision on whether to designate an embroidery region as a print target may be made by the analyzing process in regard to one more of these embroidery attributes.

In the above mentioned first embodiment, embroidery data of embroidery regions selected as a print target are deleted (S26). However, embroidery data of embroidery regions to be deleted may be given an attribute of "invalid" in place of deleting such data of the embroidery regions.

With regard to positioning stitch patterns and cutting stitch lines relating to sewing of an applique, embroidering for these stitch patterns and stitch lines may be forcibly changed to the printing because these stitch patterns and stitch lines are used as tentative referential lines and do not need to be embroidered.

If embroidery data belonging to an embroidery region targeted for printing includes underlying data, such data may be removed.

In the above mentioned embodiment, the embroidery data processing device 1 and the embroidery machine 2 are formed as separate devices. However, the control unit 42 of the embroidery machine 2 may be configured to have the functions of the embroidery data processing device 1. In this case, it is not necessary to use a personal computer functioning as the embroidery data processing device 1.

What is claimed is:

1. An embroidery data processing device, comprising:

an extracting system that extracts at least one embroidery region from embroidery data according to a stitch attribute corresponding to at least one predetermined setting; and a print data generating system that generates print data for the at least one embroidery region extracted by the extracting system based on the embroidery data of the at least one embroidery region extracted by the extracting system, wherein the at least one predetermined setting includes at least one of stitch forms including tatami stitch, satin stitch and running stitch.

2. The embroidery data processing device according to claim 1, further comprising a setting system that allows an operator to designate the at least one predetermined setting.

3. The embroidery data processing device according to claim 2, further comprising:

a block making system that divides one of the embroidery regions of the embroidery data into a plurality of blocks; and a print block designation system that allows an operator to select a block from among the plurality of blocks, wherein the print data generating system further operates to generate print data for the selected block.

4. The embroidery data processing device according to claim 1, wherein the at least one predetermined setting includes at least one thread color.

5. The embroidery data processing device according to claim 1, wherein the at least one predetermined setting includes at least one pattern form.

6. The embroidery data processing device according to claim 5, wherein the at least one pattern form includes one of a frame, a letter and a design.

7. The embroidery data processing device according to claim 1, wherein the print data generated by the print data generating system represents stitches linking sequentially needle drop points in the at least one embroidery region.

8. The embroidery data processing device according to claim 1, wherein the print data generated by the print data generating system represents data for filling the at least one embroidery region.

9. The embroidery data processing device according to claim 1, wherein the print data generating system further operates to delete the embroidery data of the at least one embroidery region.

10. The embroidery data processing device according to claim 1, further comprising an embroidery machine that embroiders an embroidery pattern based on the embroidery data.

11. The embroidery data processing device according to claim 1, further comprising a print form setting system that allows an operator to select one of print forms including solid color printing for filling the at least one embroidery region in a color and stitch printing for representing stitches in the at least one embroidery region, wherein the print data generating system generates the print data according to the selected one of the print forms.

12. The embroidery data processing device according to claim 1, further comprising a storage device in which the embroidery data is stored.

13. A computer program stored on a computer readable memory medium, the computer program comprising instructions for:

analyzing embroidery data to extract at least one embroidery region from the embroidery data according to a stitch attribute corresponding to at least one predetermined setting; and generating print data for the at least one embroidery region based on the embroidery data of the at least one embroidery region, wherein the at least one predetermined setting includes at least one of stitch forms including tatami stitch, satin stitch and running stitch.

14. The computer program according to claim 13, the program further comprising instructions for allowing an operator to designate the at least one predetermined setting.

15. The computer program according to claim 14, the program further comprising instructions for:

dividing one of embroidery regions of the embroidery data into a plurality of blocks; and allowing an operator to select a block from among the plurality of blocks, wherein in the generating step, print data for the selected block is generated.

16. The computer program according to claim 13, wherein the at least one predetermined setting includes at least one thread color.

17. The computer program according to claim 13, wherein the at least one predetermined setting includes at least one pattern form.

18. The computer program according to claim 17, wherein the at least one pattern form includes one of a frame, a letter and a design.

19. The computer program according to claim 13, wherein the print data generated by the generating instruction represents stitches linking sequentially needle drop points in the at least one embroidery region.

20. The computer program according to claim 13, wherein the print data generated by the generating instruction represents data for filling the at least one embroidery region.

21. The computer program according to claim 13, wherein the generating instruction includes deleting the embroidery data of the at least one embroidery region.

22. The computer program according to claim 13, the program further comprising instructions for allowing an operator to select one of print forms including solid color printing for filling the at least one embroidery region in a color and stitch printing for representing stitches in the at least one embroidery region, wherein in the generating instruction, the print data according to the selected one of the print forms is generated.

23. An embroidery data processing device, comprising:

a pattern division system that analyzes embroidery data to divide the embroidery data into a plurality of embroidery regions according to stitch form, thread color, and pattern form;

a designation system that allows an operator to select one or more of the embroidery regions divided by the pattern division system; and a print data generating system that generates print data for the one or more embroidery regions selected by the operator based on the embroidery data corresponding to the one or more embroidery regions.

24. A computer program stored on a computer readable memory medium by a computer, the computer program comprising instructions for:

analyzing embroidery data to divide embroidery data into a plurality of embroidery regions according to stitch form, thread color, and pattern form;

allowing an operator to select one or more of the embroidery regions divided by the analyzing instruction; and generating print data for the one or more embroidery regions selected by the operator based on the embroidery data corresponding to the one or more embroidery regions.

* * * * *